United States Patent [19]

Swisher, Jr.

[11] Patent Number: 4,989,986

[45] Date of Patent: Feb. 5, 1991

[54] DOUBLE COUNTER FLOW DRUM MIXER

[75] Inventor: George W. Swisher, Jr., Oklahoma City, Okla.

[73] Assignee: CMI Corporation, Oklahoma City, Okla.

[21] Appl. No.: 352,014

[22] Filed: May 15, 1989

[51] Int. Cl.[5] ..... B28C 5/26

[52] U.S. Cl. ..... 366/4; 366/25; 366/40; 432/111

[58] Field of Search ..... 366/4, 7, 12, 22, 24, 366/25, 40, 57, 147, 148; 432/105, 111

[56] References Cited

U.S. PATENT DOCUMENTS

| | | | |
|---|---|---|---|
| 3,404,199 | 10/1968 | Hoffmann | 432/111 |
| 3,423,222 | 1/1969 | McConnaughay | 366/24 |
| 4,342,554 | 8/1982 | Rohrbach | 432/105 |
| 4,427,376 | 1/1984 | Etnyre et al. | 366/25 |
| 4,462,793 | 7/1984 | Maeda et al. | 432/105 |
| 4,600,379 | 7/1986 | Elliott | 366/25 |
| 4,787,938 | 11/1988 | Hawkins | 106/281.1 |
| 4,913,552 | 4/1990 | Bracegirdle | 366/40 |

FOREIGN PATENT DOCUMENTS

| | | | |
|---|---|---|---|
| 70249 | 2/1915 | Switzerland | 432/111 |

*Primary Examiner*—Philip R. Coe
*Assistant Examiner*—Mark Spisich
*Attorney, Agent, or Firm*—Dunlap, Codding, Peterson & Lee

[57] ABSTRACT

A drum mixer is provided for producing an asphaltic composition. The drum mixer utilizes a first heat source located at an intermediate position within the drum mixer for producing a first current of hot gases directed towards the entry end of the drum mixer. The drum mixer also utilizes a second heat source located at the discharge end of the drum mixer for producing a second current of hot gases directed towards the entry end. Virgin aggregate is introduced into the drum mixer at the entry end of the drum mixer and is heated by the first current of hot gases. Recycle material is introduced into a mixing zone within the drum mixer between the first heat source and the discharge end. The heated virgin aggregate combines with the recycle material in the mixing zone and is further heated by the second heat source. Liquid asphalt is mixed with the virgin aggregate and recycle material in the mixing zone and the product is removed from the drum mixer at the discharge end.

11 Claims, 1 Drawing Sheet

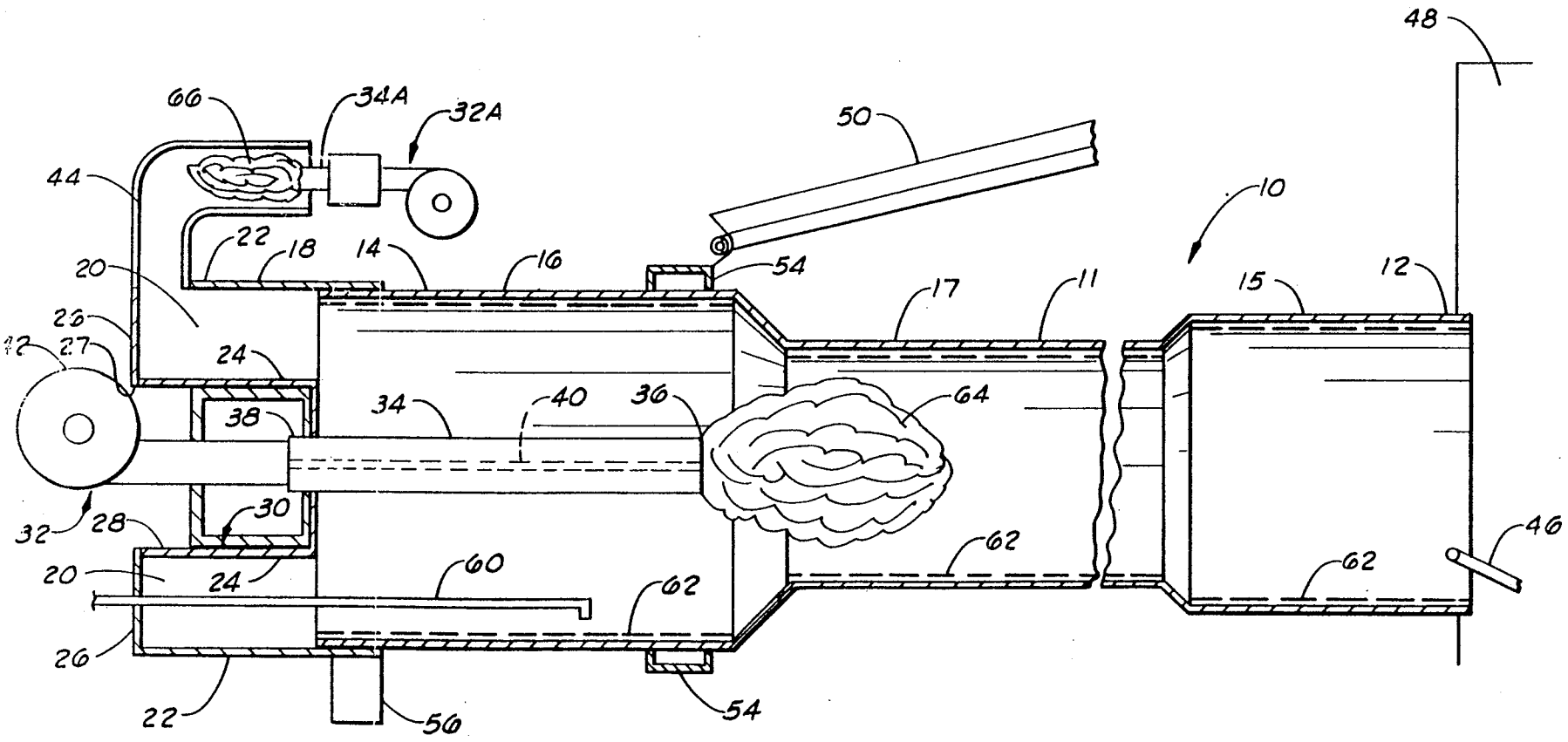
48
46
12
62
15
10
11
62
64
17
50
54
54
36
62
40
16
60
32A
56
34A
14
34
18
22
24
38
30
24
66
22
44
20
26
27
28
42
32
20
26

DOUBLE COUNTER FLOW DRUM MIXER

BRIEF SUMMARY OF THE INVENTION

1. Field of Invention

The present invention relates generally to drum mixers used for producing an asphaltic composition.

2. Background of the Invention

In the present state of the art of making hot mix asphalt in a drum mixer type plant wherein a portion of the materials used in making the composition comprises recycle asphalt, there are basically two types of drums; a parallel-flow drum and a counter-flow drum.

A parallel-flow drum is represented by U.S. Pat. Re: Nos. 31,904 & 31,905. In such a parallel-flow drum, the burner is located at the higher, input end of the drum where virgin aggregate is introduced, such that the virgin aggregate flow is parallel with the flow of the hot gases of combustion. Recycle material is introduced at a cooler zone of the drum and flows, along with the hot virgin aggregate, parallel to the flow of the hot gases of combustion, such that the recycle material is heated both by contact with the hot virgin aggregate and the gases of combustion.

A counter-flow drum is represented by U.S. Pat. No. 4,787,938. In this type of drum, the burner is located at an intermediate point in the drum with the hot gases of combustion flowing toward the higher, input end of the drum where the virgin aggregrate is introduced. Thus, the virgin aggregate and hot gases of combustion are in a counter-flowing relation. The recycle material is introduced into the drum downstream from the burner, with the hot virgin aggregate and the recycle material being mixed in the drum downstream from the burner. In this type of drum, the recycle material is heated solely, or almost solely, by contact with the hot virgin aggregate. A similar process is carried out in what is known in the art as a double barrel arrangement where the hot virgin aggregate is discharged from the lower end of a rotating during outwardly into a housing surrounding a portion of the drum, and the recycle material is introduced into the housing around the rotating drum for mixture with the hot virgin aggregate. Here again, the recycle material is heated almost solely by the hot virgin aggregate.

In the present invention, the burner is located at an intermediate position in the drum to direct a flow of hot combustion gases toward the upper, input end of the drum where the virgin aggregate is introduced, such that the flow of combustion gases and aggregate in this portion of the drum are countercurrent. The recycle material is introduced downstream from the burner and is mixed with the hot virgin aggregate in the downstream end portion of the drum. The recycle material is heated by contact with the hot virgin aggregate. Means are also provided for directing a second stream of hot combustion gases through the downstream end portion of the drum in a flow pattern countercurrent with the recycle material and virgin aggregrate being mixed, such that the recycle material is also heated by the second stream of hot combustion gases.

BRIEF DESCRIPTION OF THE DRAWINGS

FIG. 1 is a semi-schematic, vertical cross-sectional view of a drum mixer constructed in accordance with the present invention.

DESCRIPTION OF THE PREFERRED EMBODIMENT

As shown in FIG. 1, the present invention comprises a drum mixer designated generally by the reference numeral 10. The drum mixer 10 includes a drum 11 having a first end 12 and a second end 14. It will be understood that the drum 11 is positioned in a slightly inclined position wherein the level of the first end 12 is above the level of the second end 14. It will be further understood that the drum 11 may be rotated in this position by conventional drive systems.

The drum 11 is further characterized by having expanded portions 15 and 16, extending from the first end 12 and the second end 14 respectively, and a smaller diameter intermediate portion 17. Portions 15 and 17 function as what will be called the drying zone within the drum 11 and portion 16 functions as what will be called the mixing zone within the drum mixer 10.

The drum mixer 10 also includes a cylindrically shaped stationary collar 18 positioned at the second end 14 of the drum 11. Portions of the collar 18 overly the second end 14 of the drum 11 such that the second end 14 may freely rotate within the collar 18.

The collar 18 includes a first annular cavity 20 therein. The first annular cavity 20 is defined by a first cylindrical wall 22 and a second cylindrical wall 24. The second cylindrical wall 24, having a smaller cross-sectional diameter than the first cylindrical wall 22, is symmetrically disposed within the first cylindrical wall 22. The first annular cavity 20 is further defined by a side wall 26, having a central opening 27 therein. The side wall 26 is secured between the first cylindrical wall 22 and the second cylindrical wall 24 such that the end of the collar 18 opposite the second end 14 of the drum 11 is closed.

The central opening 27 is aligned with the second cylindrical wall 24 such that a cylindrical cavity 28, defined by the inside dimensions of the second cylindrical wall 24, is formed within the collar 18. A frame 30, sized for insertion into the cylindrical cavity 28 is secured in the second cylindrical wall 24 within the cylindrical cavity 28.

A first burner assembly 32 is secured in the frame 30. The first burner assembly 32 includes a tube 34, having a first end 36 extending into the drum 11 forming a burner head, and a second end 38 secured in the frame 30. The first burner assembly 32 also includes a fuel line 40, secured within the tube 34 and extending substantially the length thereof. The tube 34 is of sufficient length such that the first end 36 is positioned at an intermediate location in the drum 11 substantially at the transition between the expanded portion 16 and the smaller diameter portion 17. The first burner assembly 32 further includes a blower 42, secured to the frame 30, for sending combustion air through the tube 34. Hot gases produced at the first end 36 of the tube 34 by the first burner assembly 32 flow from the first end 36 towards the first end 12 of the drum 11.

The drum mixer 10 also includes a second burner assembly 32A. The second burner assembly 32A is similar to the first burner assembly 32 except that the tube 34A of the second burner assembly 32A is substantially shorter than the tube 34 of the first burner assembly 32. Hot gases produced by the second burner assembly 32A enter the collar 18 via a duct 44. It will be understood that the hot gases entering the collar 18 are dispersed into the second end 14 of the drum 11 through the annular cavity 20. The hot gases entering the drum 11 from the collar 18 flow from the second end 14 of the drum 11 towards the first end 12 of the drum 11.

A first volume of material, preferably virgin aggregate (not shown), is introduced into the first end 12 of the drum 11 by a conveyor 46. The drum mixer 10 is also provided with a conventional exhaust collection system 48. The exhaust collection system 48 overlies the first end 12 of the drum 11 such that pollutants exiting the drum 11 at the first end 12 are retained within the exhaust collection system 48.

A second volume of material, either virgin aggregate or recycle asphalt material (not shown), is delivered to an intermediate location of the drum 11 via a conveyor 50. The second volume of material is introduced into the drum 11 between the first end 36 of the tube 34 and the second end 14 of the drum 11 through a material entry collar 54. Materials entering the drum mixer 10 are discharged therefrom through a discharge structure 56 secured to the collar 18 adjacent the end 14 of the drum 11.

The drum mixer 10 further includes a liquid asphalt injection tube 60. The liquid asphalt injection tube 60 is secured in the collar 18 and extends for a distance into the expanded portion 16 of the drum 11. Additionally, a plurality of flights 62 are secured within the drum 11 between the first end 12 and the second end 14.

In accordance with the present invention, the method for continuously producing an asphaltic composition preferably is carried out by rotating the drum 11 and introducing a first volume of material, preferably virgin aggregrate, into the first end 12 thereof. As the first volume of material flows from the first end 12 of the drum 11 towards the second end 14 of the drum 11 it is lifted by the flights 62 such that curtains of falling material are created within the drum 11.

The first volume of material is heated within the drum mixer 10 by creating a first flame 64 at the first end 36 of the tube 34. The hot gases produced by the first flame 64 are directed towards the first end 12 of the drum 11. In this way, the hot gases produced by the first flame 64 flow in a countercurrent relation to the flow of the first volume of material within the drum mixer 10.

A second volume of material, preferably recycle asphalt material, is introduced into the drum mixer 10 through the material entry collar 54. The second volume of material flows within the drum 11 from the material entry collar 54 towards the second end 14 of the drum 11. Alternatively, the seconde volume of material may be virgin aggregate material.

The second volume of material is mixed with the first volume of material in the expanded portion 16 between the first flame 64 and the second end 14 of the drum 11. As the first and second volumes of material flow towards the second end 14 of the drum 11, the materials are lifted by the flights 62 in the expanded portion 16 such that curtains of falling materials are created therein.

There will be some transfer of heat by conduction from the hot first volume of material to the cooler second volume of material entering the drum through the collar 54. In addition, the first and second volumes of materials are heated within the expanded portion 16 by use of the second flame 66. The hot gases generated by the second flame 66 are directed into the collar 18 and flow from the second end 14 of the drum 11 to the first end 12 of the drum 11. In this way, the hot gases produced by the second flame 66 flow in a countercurrent relation to the flow of materials in the expanded portion 16.

It is understood that, depending upon the composition of the second volume of material, a certain quantity of liquid asphalt sufficient to produce an asphaltic composition is injected through the tube 60 and into the expanded end 16 of the drum 11. The liquid asphalt is mixed with the first and second volumes of materials to produce the desired asphaltic composition. The asphaltic composition is discharged from the second end 14 of the drum 11 through the discharge structure 56. It will be understood that continuous quantities of the first and second volumes of material are introduced into the drum mixer 10 such that a continuous discharge of asphaltic composition is produced.

Changes may be made in the construction, operation, and arrangement of the various parts, elements, steps, and procedures described herein without departing from the spirit and scope of the invention as defined in following claims.

I claim:

1. In a method for continuously producing an asphaltic composition comprising the steps of:

introducing a first volume of material into an inclined, rotating drum at a first end to flow generally from the first end to a second end of the drum;

creating a flame at an intermediate location in the drum and directing the hot gases produced thereby to flow towards the first end of the drum in countercurrent relation to the first volume of material for heating the first volume of material;

introducing a second volume of material into the drum between the flame and the second end of the drum to flow generally to the second end of the drum;

mixing the heated first volume of material with the second volume of material between the flame and the second end of the drum;

generating a second stream of hot gas to flow from the second end of the drum to the first end of the drum in countercurrent relation to the flow of said materials for heating the mixing first and second volumes of materials; and discharging the asphaltic composition from the second end of the drum.

2. The method of claim 1 including the step of mixing liquid asphalt with the mixing virgin aggregate and the recycle asphalt material to produce the asphaltic composition.

3. The method of claim 1 wherein the first volume of material is virgin aggregrate material and the second volume of material is recycle asphalt material.

4. The method of claim 1 wherein the first volume of material is virgin aggregate material and the second volume of material is virgin aggregate material.

5. An apparatus for producing an asphaltic composition comprising:

a rotatable drum having a first end and a second end;

means for creating a first flow of hot gases at an intermediate position within the rotatable drum, wherein the first flow of hot gases are directed towards the first end of the rotatable drum;

means for creating a second flow of hot gases at the second end of the rotatable drum, wherein the second flow of hot gases are directed towards the first end of the rotatable drum;

means for supplying a first material into the rotatable drum at the first end thereof, wherein the first material is exposed to the first flow of hot gases, and wherein the first material travels within the rotatable drum in a countercurrent direction to the first flow of hot gases;

means for supplying a second material into the rotatable drum between the origin of the first flow of hot gases and the second end of the rotatable drum, wherein the second material travels within the rotatable drum in a countercurrent direction to the second flow of hot gases;

means for mixing the first material and the second material between the origin of the first flow of hot gases and the second end of the rotatable drum, wherein the first and second materials are exposed to the second flow of hot gases; and means for discharging the mixture of the first and second materials at the second end of the rotatable drum.

6. The apparatus of claim 5 further comprising means for introducing liquid asphalt to the mixing first and second materials.

7. The apparatus of claim 5 wherein the means for creating a first flow of hot gases includes a first burner assembly having a burner head positioned within the rotatable drum between the first end and the second end thereof.

8. The apparatus of claim 5 wherein the means for creating a second flow of hot gases includes a second burner assembly positioned at the second end of the rotatable drum.

9. The apparatus of claim 5 further comprising a collar having a cavity, wherein the collar is sized for overlying the second end of the rotatable drum such that the second end rotates freely within the cavity, and wherein the hot gases created by the second burner assembly are conveyed into the cavity by a duct.

10. The apparatus of claim 5 wherein the first material is virgin aggregate and the second material in recycle asphalt.

11. The apparatus of claim 5 wherein the first material is virgin aggregate and the second material is virgin aggregate.

* * * * *